US005486007A

United States Patent [19]

Stewart et al.

[11] Patent Number: 5,486,007

[45] Date of Patent: Jan. 23, 1996

[54] AUTOMATED DART BOARD

[75] Inventors: Mark F. Stewart, St. Davids; Angelo A. Bonetta, Niagara on the Lake; Majinder S. Phull, Mississauga, all of Canada

[73] Assignee: High Flyte International Ltd., Bermuda

[21] Appl. No.: 239,552

[22] Filed: May 9, 1994

[51] Int. Cl.[6] ..... F41J 3/00; F41J 5/04

[52] U.S. Cl. ..... 273/374

[58] Field of Search ..... 273/371, 372, 273/373, 374, 377

[56] References Cited

U.S. PATENT DOCUMENTS

| | | | |
|---|---|---|---|
| 2,592,429 | 4/1952 | Kimmel et al. . | |
| 3,101,198 | 8/1963 | Williams . | |
| 3,275,321 | 9/1966 | Forest . | |
| 3,454,276 | 7/1969 | Brenker et al. . | |
| 3,677,546 | 7/1972 | Oetiker . | |
| 3,705,725 | 12/1972 | Thalmann | 273/373 |
| 3,854,722 | 12/1974 | Ohlund et al. | 273/373 |
| 4,014,546 | 3/1977 | Steinkamp . | |
| 4,057,251 | 11/1977 | Jones et al. . | |
| 4,244,583 | 1/1981 | Wood et al. . | |
| 4,561,660 | 12/1985 | Zammuto . | |
| 4,586,716 | 5/1986 | Brejcha et al. . | |
| 4,651,998 | 3/1987 | Holt et al. . | |
| 4,706,962 | 11/1987 | Michalski . | |
| 4,852,888 | 8/1989 | Ross et al. . | |

FOREIGN PATENT DOCUMENTS

| | | |
|---|---|---|
| 2013904 | 10/1970 | Germany . |
| 1532744 | 11/1978 | United Kingdom . |
| 2217618 | 11/1989 | United Kingdom . |

OTHER PUBLICATIONS

D. T. W. Jenkins, "Project Arachnid Report on the Pre–University cource project. 1973", Document Reg. No. ESS/SS534, Dec. 1973, pp. 122–187.

*Primary Examiner*—William H. Grieb

*Attorney, Agent, or Firm*—Evenson, McKeown, Edwards & Lenahan

[57] ABSTRACT

A target for regulation grade metal tipped darts has a conductive rigid web made up of concentric rings intersecting spokes emanating from the second to the innermost ring. The spokes define twenty sectors, while the rings define 4 segments within each sector. There are also two segments in the innermost and second to innermost rings. Conductive blocks, made up of an aluminum or zinc cup having contacts protruding from its bottom and containing a rubberized cork insert, fill in the segments of the web. Beneath each cup is a silicon foam cushion cut away between the contacts and a pad on a printed circuit board. The pads are each connected to circuitry that senses when a dart hits an insert causing the corresponding cup to slide within the web and contact a pad. The circuitry, by way of a piezoelectric sensors, also determines if a dart has impacted on or near the target and checks to see if the target has polled a segment that indicates a hit on the target, failing which the target indicates that the dart missed the target. The circuitry also senses the rotational orientation of the target and sets the basic scores of the segments accordingly, allowing the target to be periodically rotated to reposition segments in sectors of heavy use to sectors of lighter use.

30 Claims, 13 Drawing Sheets

AUTOMATED DART BOARD

FIELD OF THE INVENTION

The invention relates to automated dart board systems. More particularly, it relates to such systems where the system is capable of indicating the location of the dart within a given segment of the board.

BACKGROUND OF THE INVENTION

Although automated dart boards are desirable in homes as well as public locations, it is in public locations that they are used to best advantage. By employing automated scoring, the system knows when a match has commenced and when it has ended. This allows the system to use automated revenue collection means, such as are used in video or arcade games.

It is very important for this type of market to have accurate scoring, combined with a realistic game. Paying customers will not otherwise be satisfied with games that the system provides. Of course, if the games are accurate and realistic then, when placed in a good location, the system will be used a great deal. Thus, it is also desirable for the system to be durable, and for parts that wear to be easily interchangeable. As shown by the art in this field, many attempts have been made to create such a system. The most successful system has been the type shown in British patent specification 1 532 744 of Jones et al filed May 30, 1977, and published Nov. 22, 1978. Jones discloses a system employing plastic tipped darts and an array of target plates moulded with a large number of closely spaced holes corresponding substantially in size to that of the tip. When the dart is thrown at the board, the tip enters into one of the holes and remains in the hole until removed by one of the players. For automated scoring, a given target plate is slidably supported and, when a given target plate is struck by a dart, the plate slides inwardly to effect closure of an electrical switch contact which directs a signal to a scoring register.

Obviously, the Jones system is not designed to employ regulation grade metal tipped darts of the type preferred by serious dart players. The games are not sufficiently realistic for a wide segment of the market. In addition to the modifications required for reception and retention of grade metal tipped darts, the switches used and the plastic target plate struck by a dart are typically not strong enough to withstand continuous heavy impact from grade metal tipped darts.

Holt et al in U.S. Pat. No. 4,651,998 issued Mar. 24, 1987 discloses a safe tip dart system such as that in Jones et al. Holt et al add a bullseye detection mechanism wherein the dart board deforms, or alternatively a plate slides within the board, to actuate a contact switch that causes a timer circuit to activate an audible alarm. This provides an additional attraction for playing the game. The Holt et al bullseye provides only a means to actuate a bullseye segment and only in conjunction with an all plastic safe tip dart board. As safe tip darts are being used, wear of the segments is not a factor, and no means is discussed for lengthening time between replacement or for facilitating replacement.

Automated regulation dart systems are shown in the following U.S. Pat. Nos. 4,852,888 issued Aug. 1, 1989 to Ross et al; 4,244,583 issued Jan. 13, 1981 to Wood et al; 4,014,546 issued Mar. 29, 1977 to Steinkamp; 3,677,546 issued Jul. 18, 1972 to Oetiker; 3,275,321 issued Sep. 27, 1966 to Forest; 3,101,198 issued Aug. 20, 1963 to Williams. Dart conductive systems have a first conductive layer part of the way into the segment and a second conductive layer further into the segment. The conductive layers are at two different potentials. When the dart enters the segment it pierces the first layer and the second layer which causes current to flow between the layers and indicates the location of the dart. Ross, Forest and Williams disclose modified systems of this type.

Dart conductive systems wear out in the conductive layers as they are continually pierced. As well, darts may not pierce both layers and a score will not be recorded. This can happen when the dart has insufficient energy to reach both layers or the dart enters at an angle. It is also desirable to have the dart create an impulse contact, rather than a constant contact between the conductive layers. This simplifies the operation of circuitry in the system. For a system that operates on a continuous contact see Wood et al. Most dart conductive systems use a mechanical means of moving the dart from contact with one of the layers or moving one of the layers from contact with the dart. This adds complexity to the mechanical operation of the system.

It is an object of the invention to address one or more of these perceived deficiencies in the field or other needs as will become evident from the following description.

SUMMARY OF THE INVENTION

In a first aspect the invention provides a target for use with a projectile. Examples of such projectiles are regulation grade metal tipped darts, plastic tipped darts, target gun shooting (pellet, b.b. bullets), archery, dartguns, blowguns, and games that use projectiles that are not intended to remain in the target, such as balls striking the target. The target has a web made from conductive material. The web defines a target face and has a depth. The web also defines one or more segments within the web that open toward the target face. One or more conductive blocks are mounted for sliding within the web and substantially fill the target face of one or more segments of the web. Each block contacts the web. A back board is mounted to and behind the web with at least one conductive pad for each of the cups. Each of the conductive cups has a resilient cushion, between each cup and the back board. The projectile impacts a block at the target face with sufficient force to cause the block for that insert to slide within the web and contact a pad beneath that block. The cushion beneath that block returns the block to its original position.

In a second aspect the invention also provides a target for use with a projectile. This aspect is similar to the first, but the web must be rigid and the blocks are made up of conductive cups and of inserts. The conductive cups are mounted to slide within the web and fill the target face of one or more segments of the web. Each cup contacts the web and has a mouth that opens toward the target face. An insert is mounted within and fills each cup to the target face. The projectiles impact the inserts at the target face with sufficient force to cause the conductive cup for that insert to slide within the web and contact a pad beneath that cup, and the cushion beneath that cup returns the cup substantially to its original position.

This target may also be used with projectiles that are darts. The insert in that case is formed from a material for receiving and retaining the darts. The insert could be formed from a material for rifling in behind the darts when they are removed.

The web could also take the shape of a traditional dart board with a series of concentric spaced apart rings and a series of equally spaced spokes emanating from the second to the innermost ring. The spokes define circular sectors, the two innermost rings define two segments, and intersecting spokes and rings define the remainder of the segments. The innermost ring could be connected by a quick release mechanism to the back board for quick removal of the innermost ring and easy access to the conductive cup in the innermost ring in order to remove that cup from the target. The quick release mechanism could have at least one extension of the innermost ring through the back board, that extension would have a groove parallel to the back board for receiving a snap ring or other fastening device that maintains the back board snugly against the unextended portion of the innermost ring.

The back board could have a main board and a centre board, with the main board having an area beneath the inside diameter of the second to the innermost ring removed. The centre board in that case would extend beneath that area and overlap the main board. The previously mentioned extensions extend through the centre board. In addition, the second to the innermost ring has extensions through the centre board. The main board has projections beneath the unextended portion of the second to the innermost ring. These latter extensions also have a groove parallel to the centre board for receiving a snap ring or other fastening device that maintains the centre board and main board snugly against the unextended portion of the second to the innermost ring.

The web may have a tip on each of the rings and spokes. The tip extends into the segments and retains each of the conductive cups. The tip may cover the face of the web and the rim of each conductive cup. The tip could be made from a material that can withstand the impact of darts over a long period of use.

The inserts could be made from rubberized cork. It is possible to glue the inserts to their respective cups. The cushions can be formed from foam rubber, which can be open celled silicon foam.

The back board may be a printed circuit board and the pads are traces on the back board.

The web and the cups may be formed from aluminum, or from zinc or another alloy.

For a traditional dart board, the web would have 6 rings, and the back board would conductively connect the pads beneath segments in the same sector between the second and third to the innermost rings and the fourth to the fifth innermost rings.

The target may have circuitry to poll each of the pads at least once during the time that contact would likely be occurring between a cup and a pad as the result of an impact from a projectile.

The web may be normally held at one potential, while the pads are normally held at another potential. The cups through contact with the web would be at the first potential and contact between a cup and pad would cause a momentary change in the potential of the pad, and polling by the circuitry would sense the change in potential.

The target may have a vertical sector sensor for determining the sector that is in the vertical position. In this case, the target could have switches for selecting the sector that is to be in the vertical position. The target may also detect the rotational position of the target.

The target could also have a no hit detection means for vibrationally sensing a dart hitting on or near the target and determining if contact has been made between a cup and a pad approximately when the dart impacted on or near the target, and if no such contact was made, providing a no hit indication.

BRIEF DESCRIPTION OF THE DRAWINGS

For a better understanding of the present invention and to show more clearly how it may be carried into effect, reference will now be made, by way of example, to the accompanying drawings which show preferred embodiments of the present invention and in which.

Figure 1:
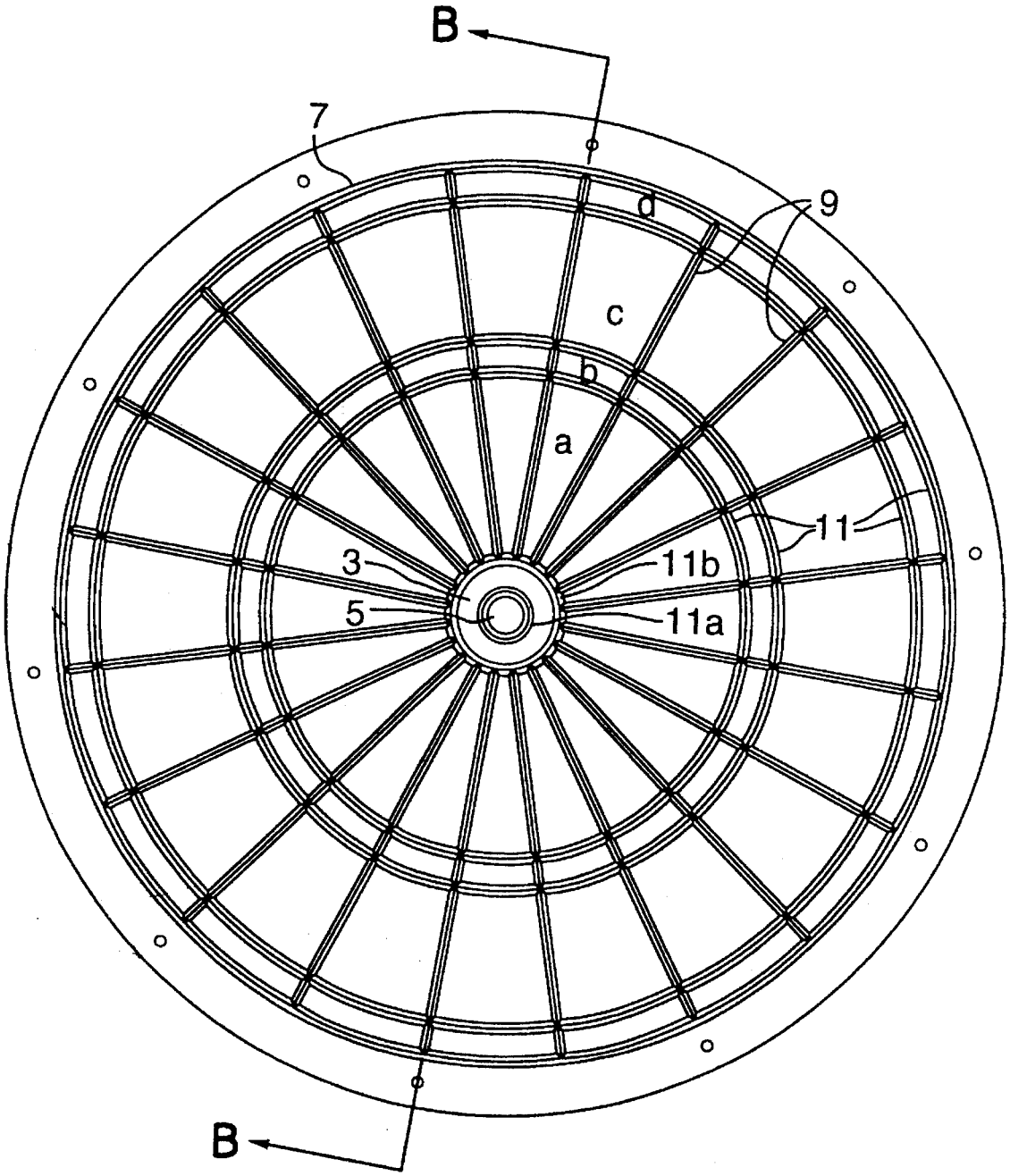
FIG. 1 is a target according to the preferred embodiment of the present invention.
Figure 2:
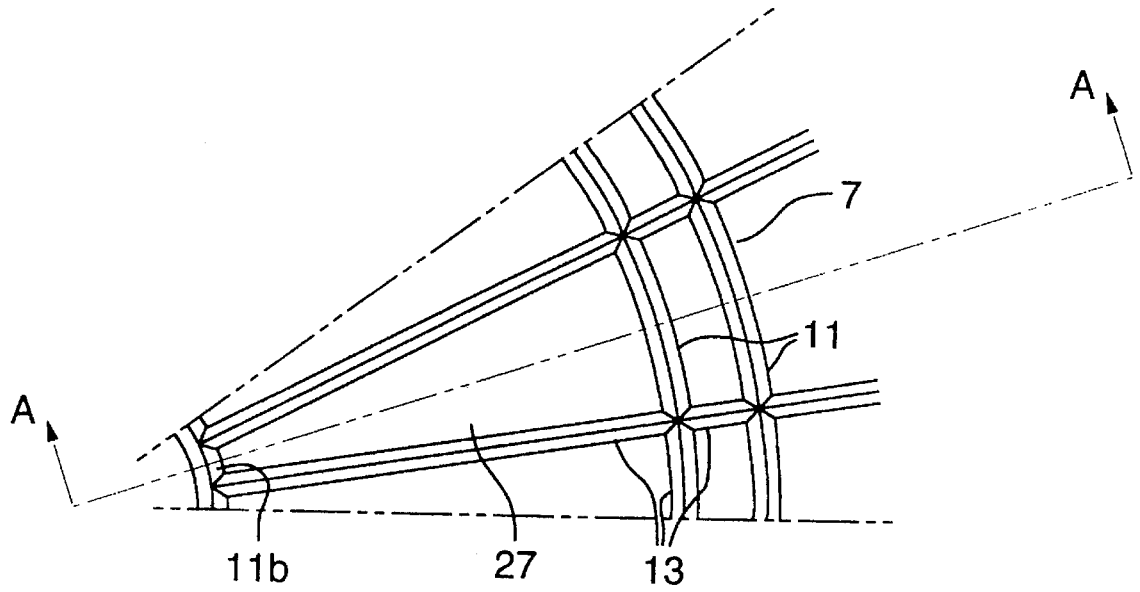
FIG. 2 is a partial top view of the target of FIG. 1, including an inner single point section and a triple point section.
Figure 3:
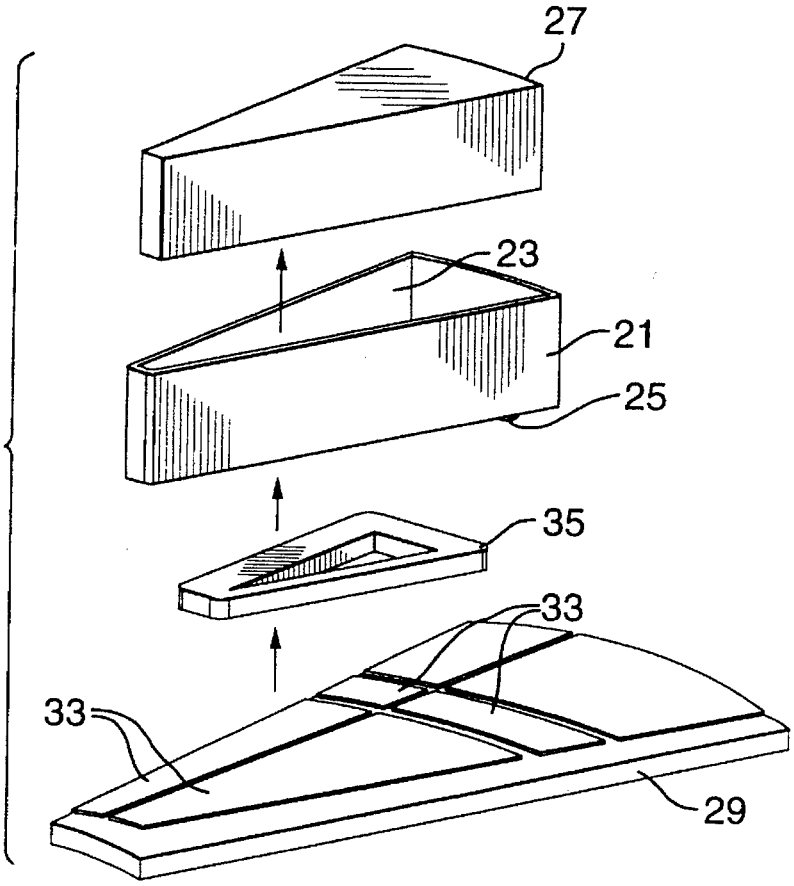
FIG. 3 is an exploded perspective view from above and to one side of parts of the target of FIG. 1, including an insert, a conductive cup, a foam spring, and part of a contact board.

FIGS. *6a–6g* are partial schematic views of a target board circuit used in the target of FIG. 1.

Figure 7:
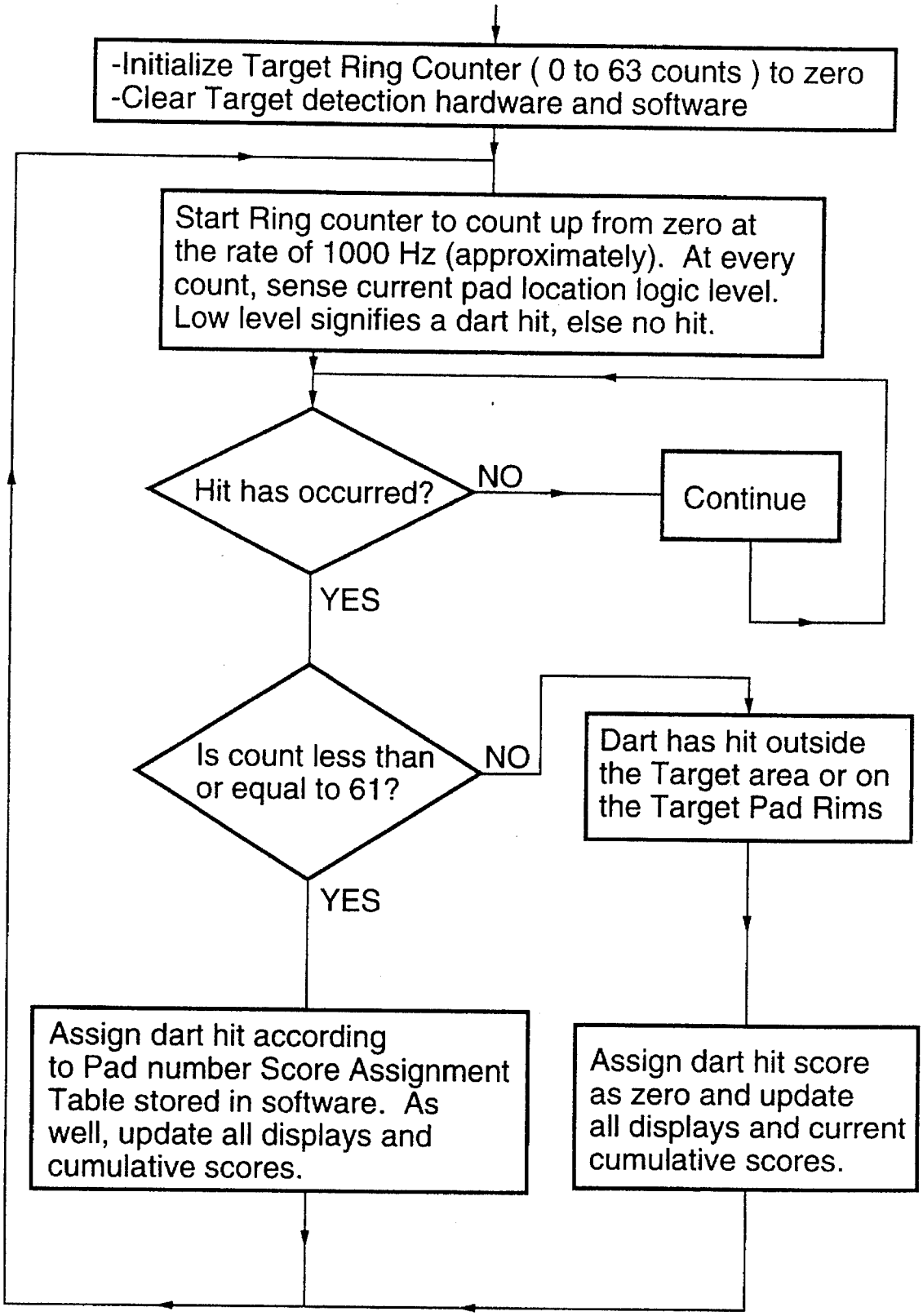

FIG. 7 is a flowchart of a program used in conjunction with the target of FIG. 1.

Figure 8:
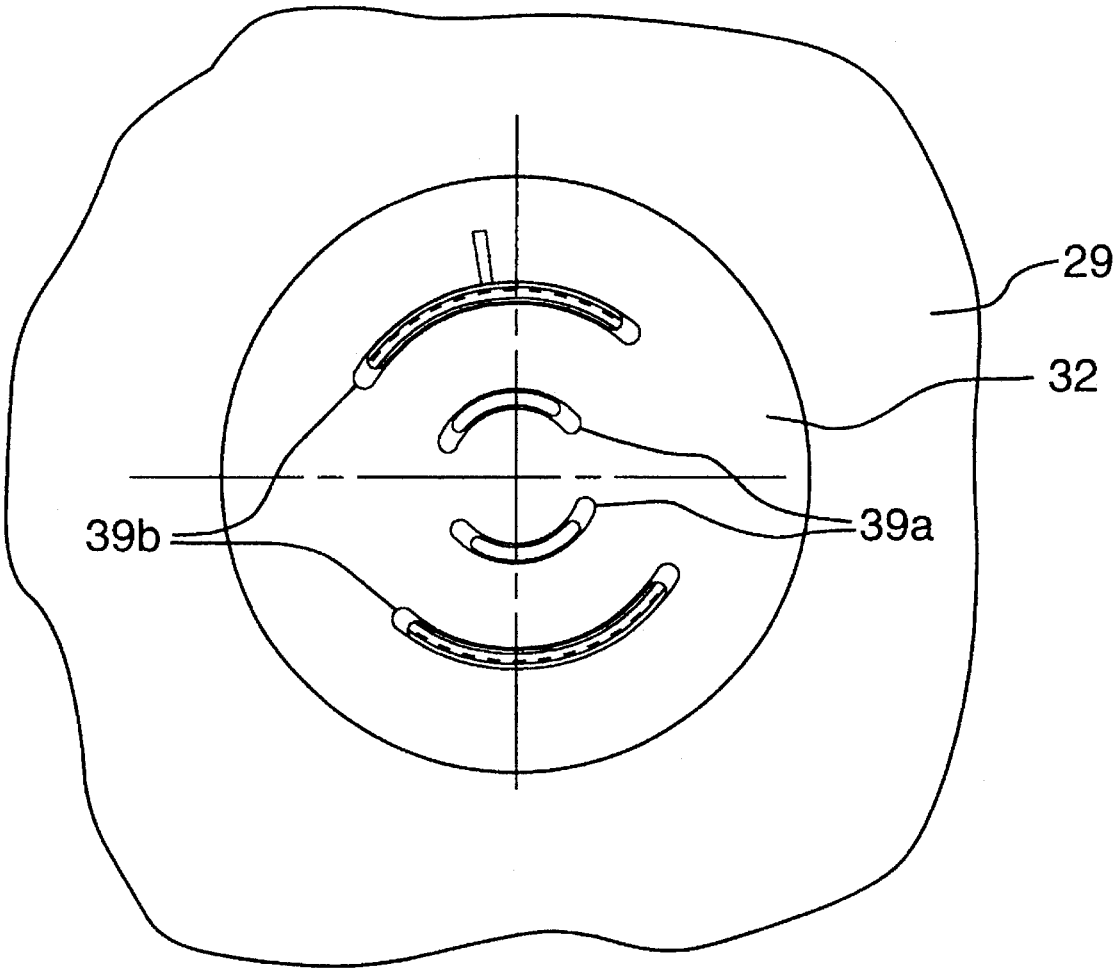

FIG. 8 is a partial rear view of a main printed circuit board and a twenty-five and fifty point printed circuit board for use in the target of FIG. 1.

DETAILED DESCRIPTION OF THE PREFERRED EMBODIMENT

The following description contains reference to specific dimensions, other quantities, and materials. These are included for ease of creating a target similar to that of the preferred embodiment. Please note that they are typical only and the invention is not limited to them. For example, the target board will be described for use with regulation grade metal tipped darts, however alternate embodiments could be configured with consequent modification to the dimensions, other quantities and materials to match the specifications of the dart, or other projectile, being used. Games and sports using suitable projectiles include, for example, target gun shooting (pellet, b.b. bullets), archery, dartguns, blowguns, and games that use projectiles that are not intended to remain in the target, such as balls striking the target.

Referring to FIG. 1, a target board 1 is divided into 20 circular sectors surrounding a circular segment 3 and a concentric annular segment 5. Each sector is divided into 4 segments, shown for example as a, b, c, d in FIG. 1, that are defined by circular arcs of different radii. The total number of segments is 82, 4 for each sector plus segments 3 and 5.

Adjacent segments of different sectors have the same relative value. Segments a and c of each sector are given a basic score, whereas the outermost segment d is double score and segment b is triple score. Thus, of the 80 segments contained in all the sectors, only 60 unique segments exist.

All sectors are the same except for their respective positions along the circumference of The target 1. The basic score that is conferred on each sector is dependent on the position of the sectors when the target 1 is installed. For example, a specific sector that is in the upper vertical position on installation usually has a basic score of 20.

Adjacent to the 20 sector in the counterclockwise direction is a sector with a basic score of 5, and in the clockwise direction is a sector with the basic score of 1. Rotating the sectors clockwise by one sector will move the sector with basic score 5 into the 20 position and the one with basic score of 20 into the 1 position.

Figure 4:
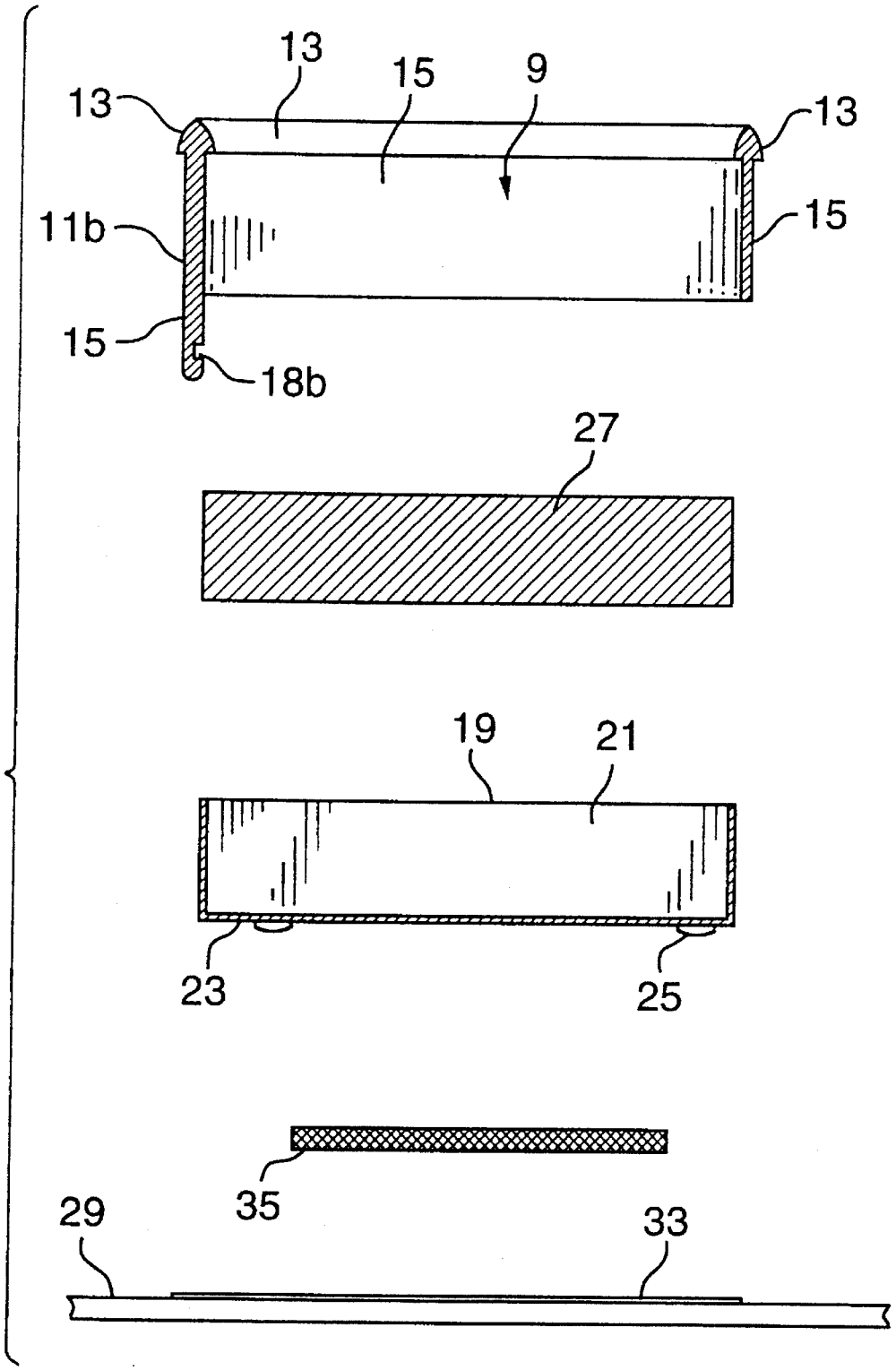
FIG. 4 is an exploded cross-section along the line A—A' of FIG. 2.
Figure 5:
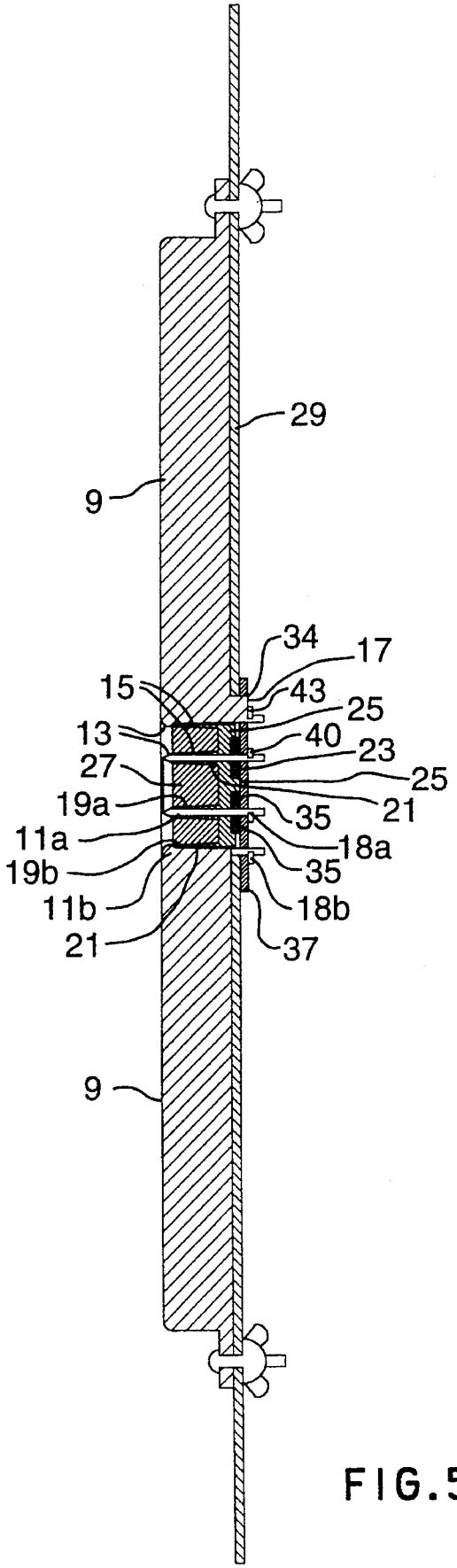
FIG. 5 is a partial cross-section along the line B—B' of FIG. 1.
Figure 6A:
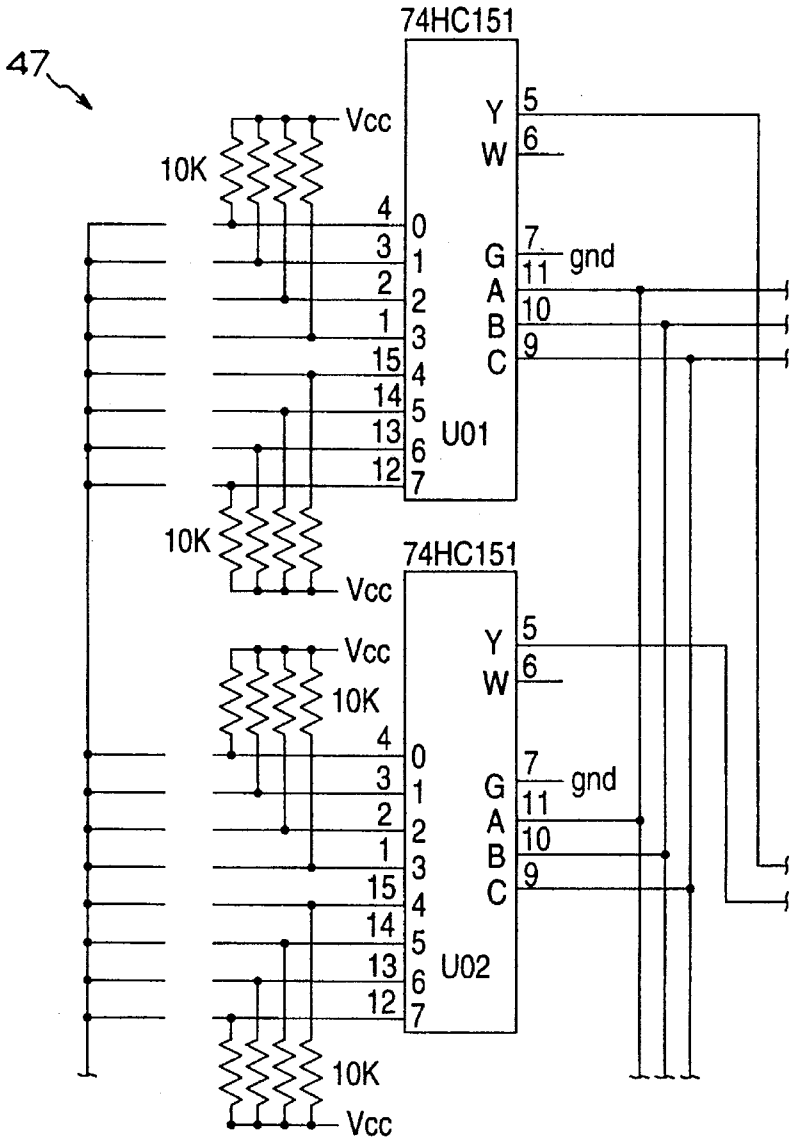
Figure 6B:
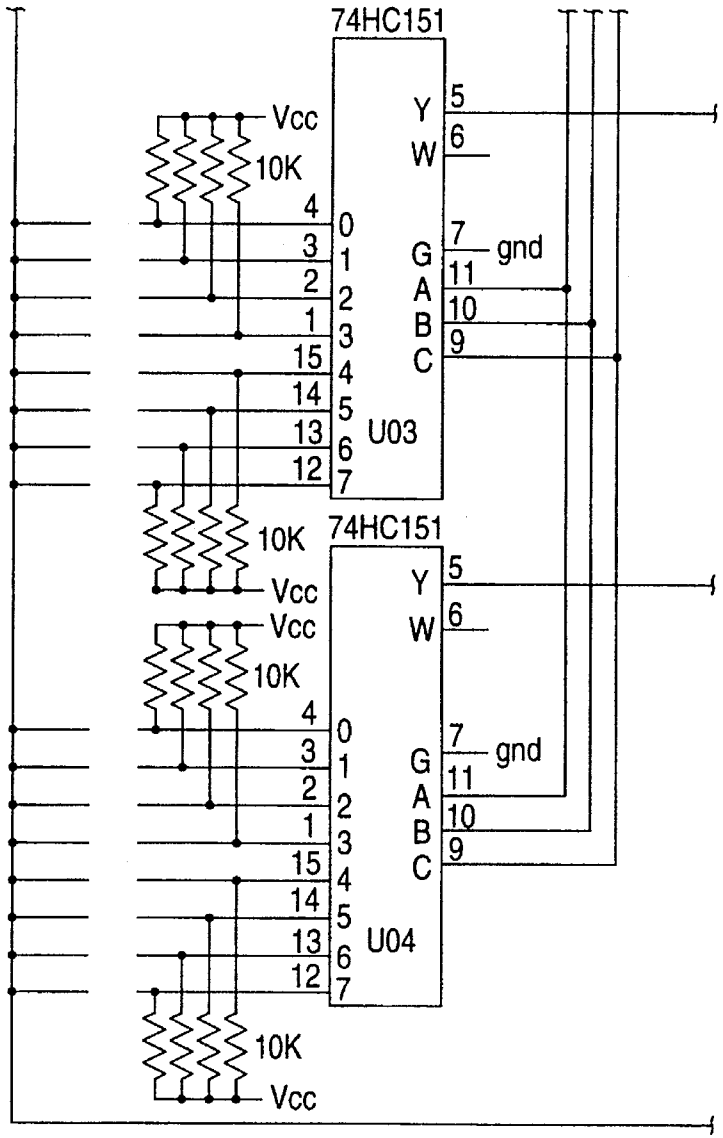
Figure 6C:
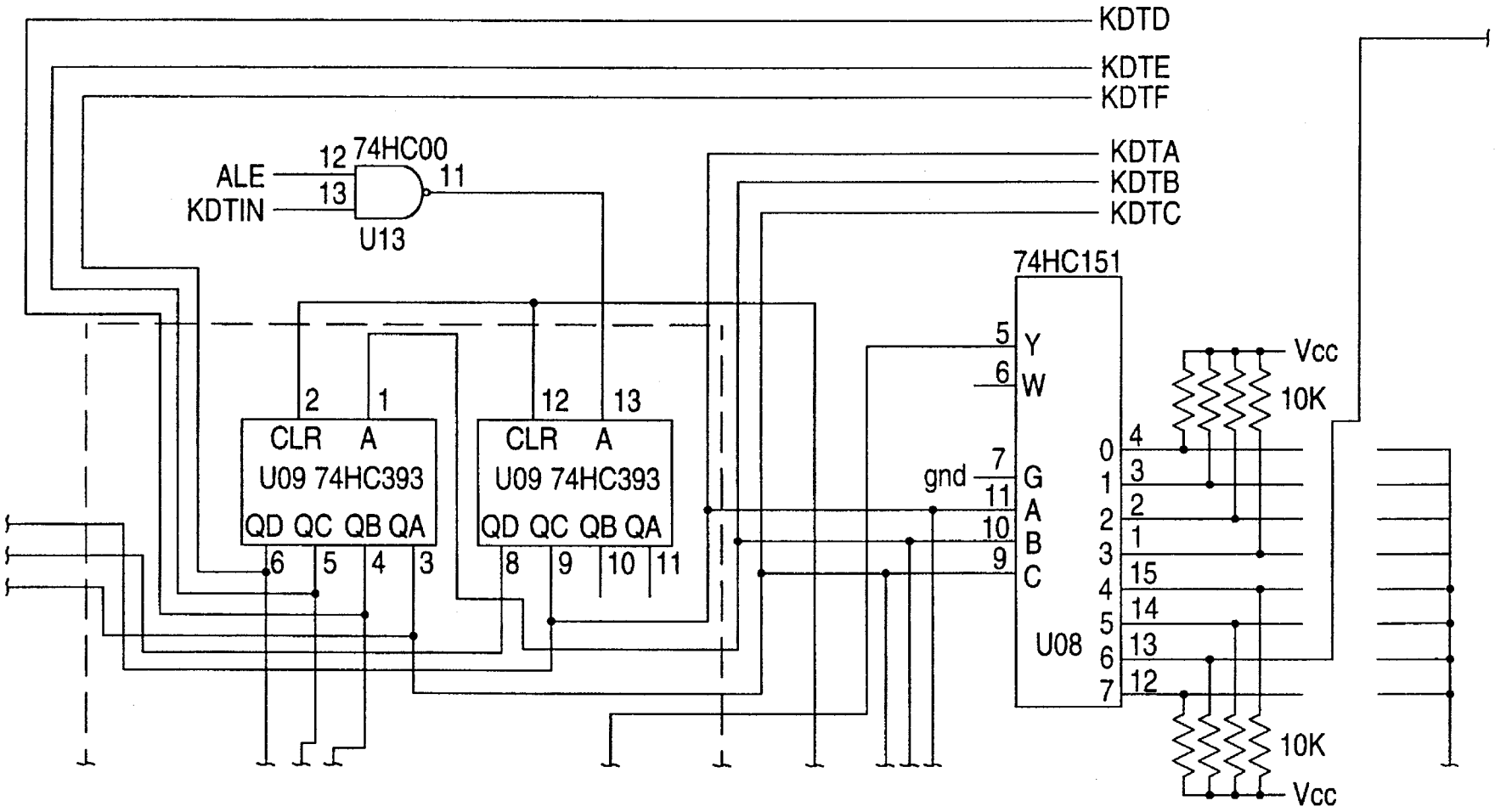
Figure 6D:
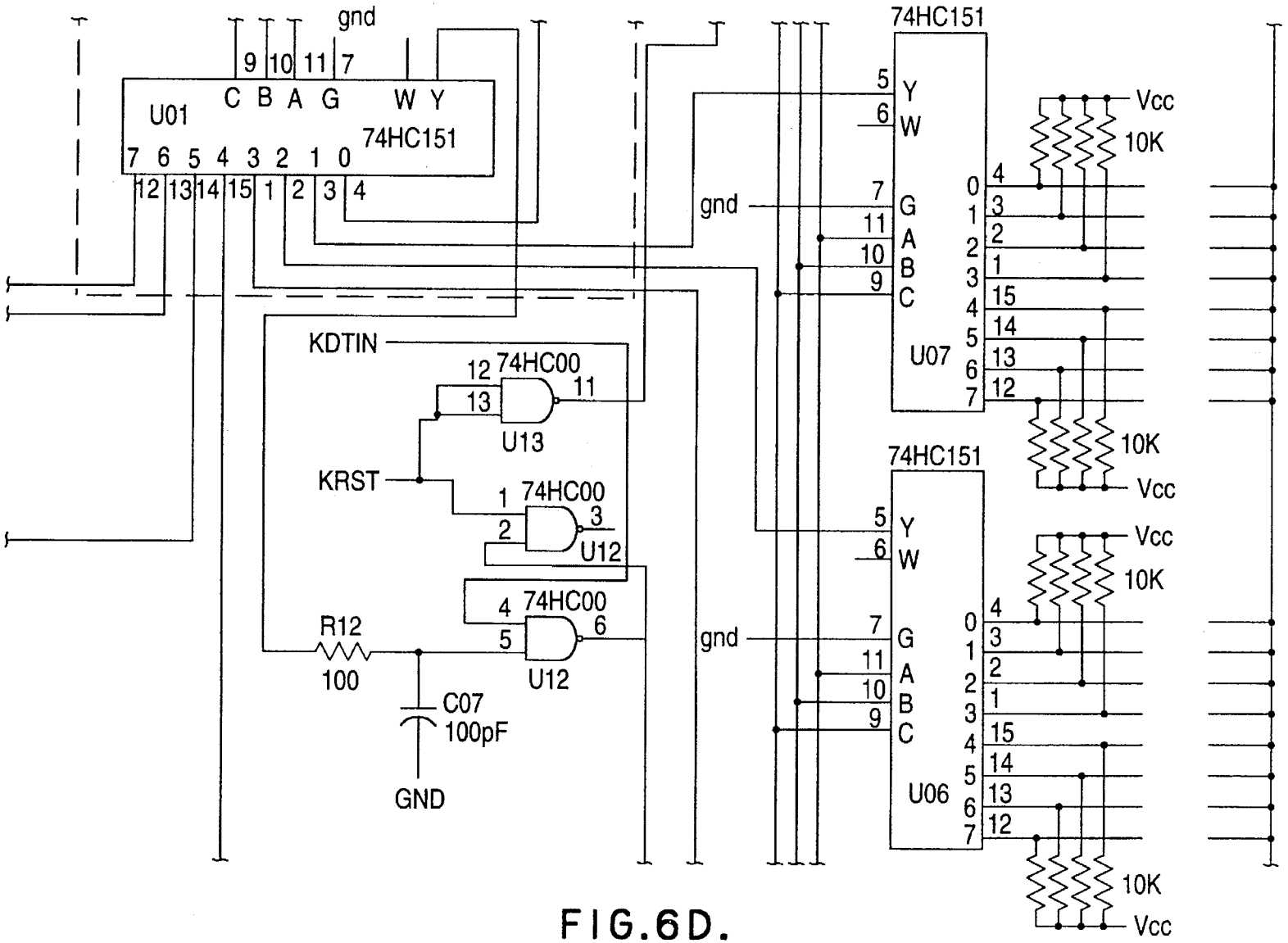
Figure 6E:
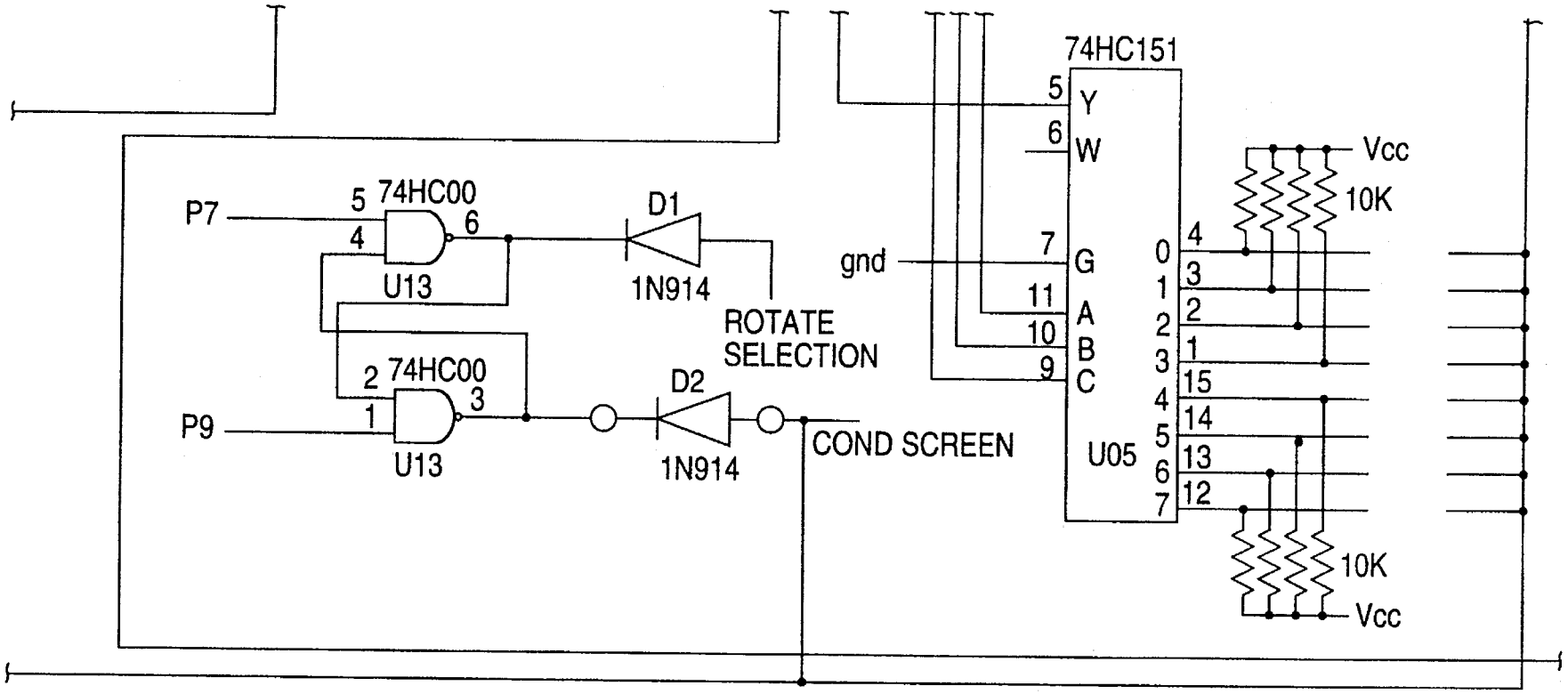
Figure 6F:
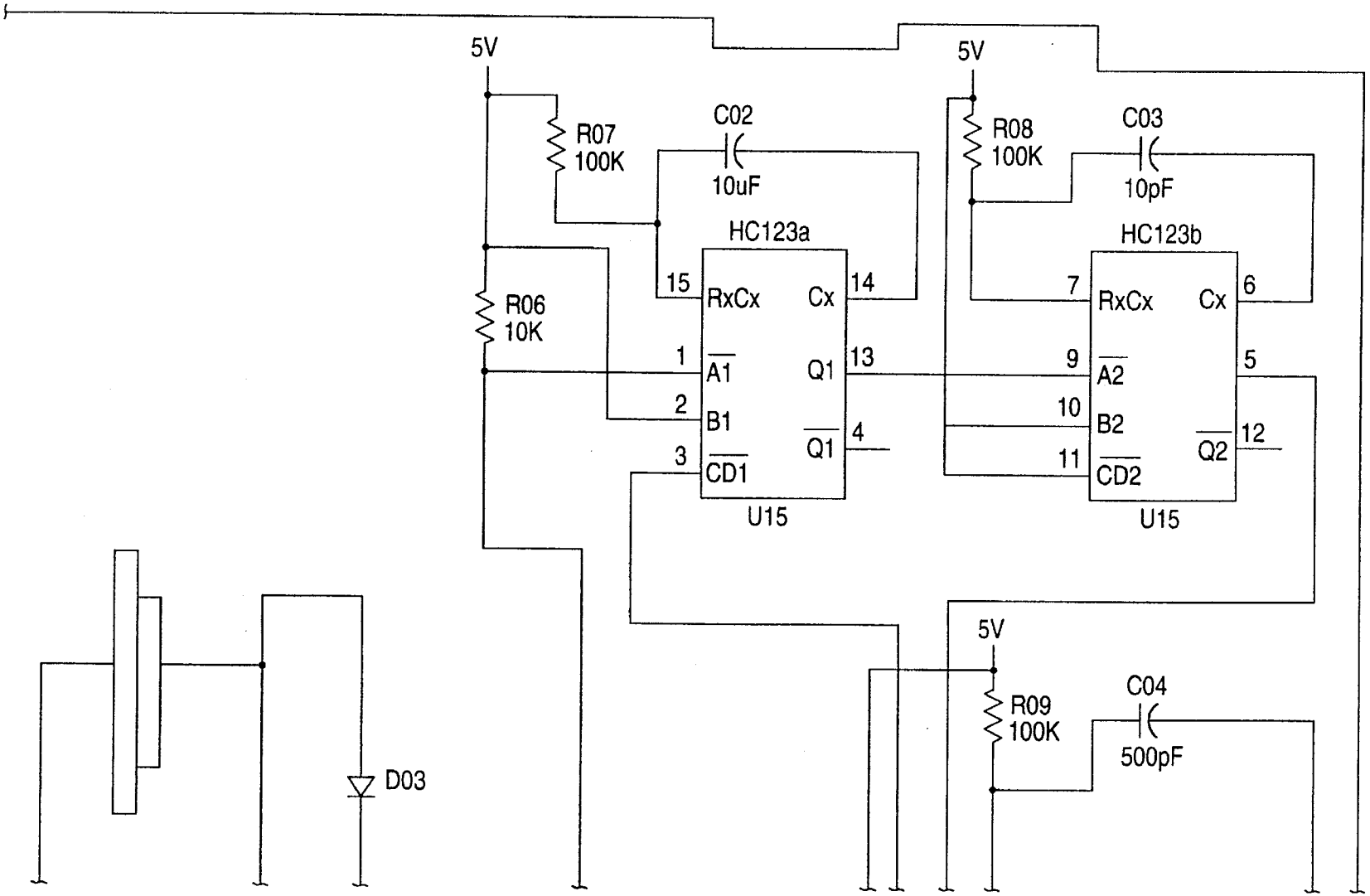
Figure 6G:
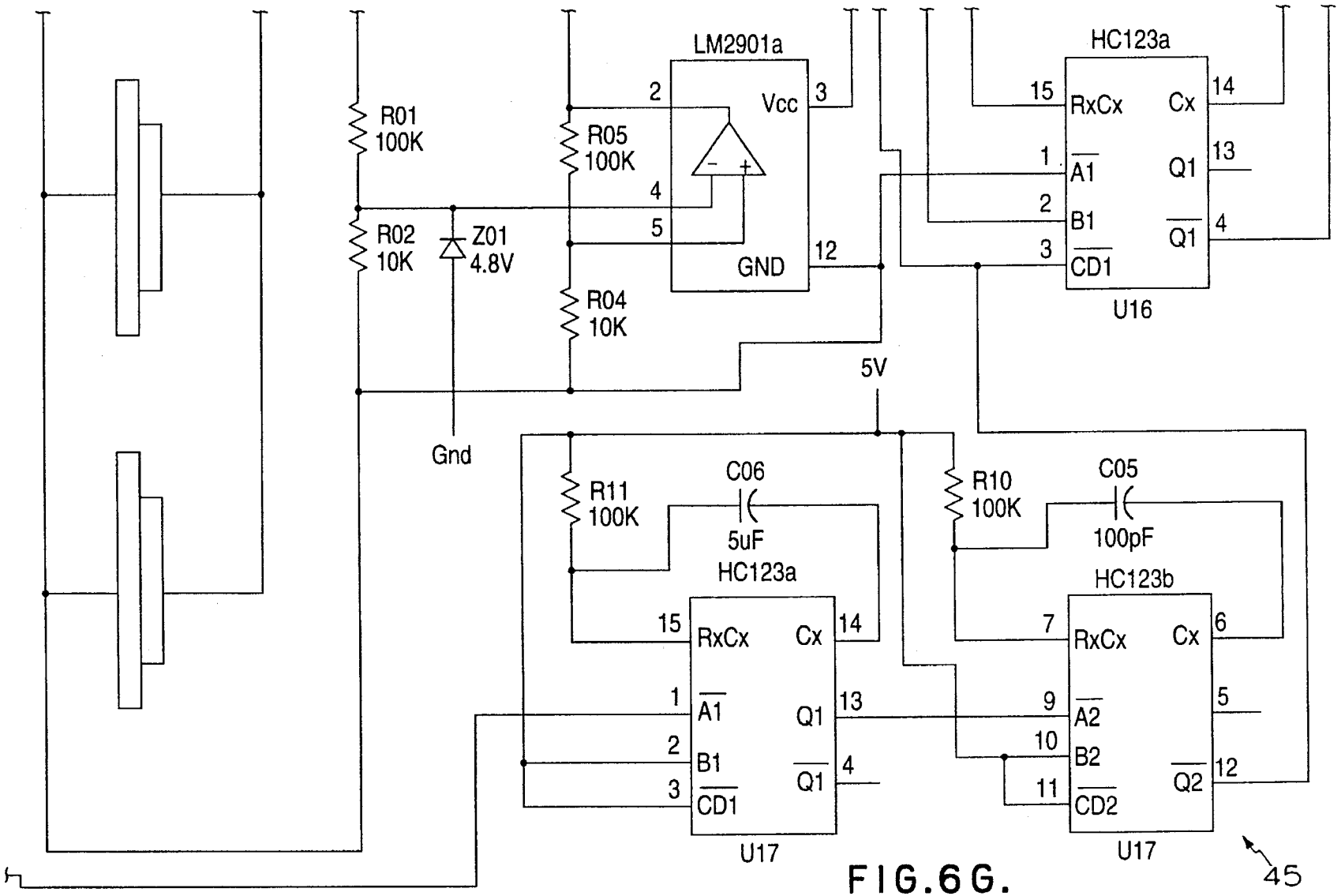

A web 7 has spokes 9 dividing each of the sectors and the web 7 has rings 11 radially dividing each segment from the other. Referring in particular to FIGS. 1 and 4, each of spokes 9 and rings 11 has an arrow-shaped cross-section, with tips 13 and stems 15. The spokes 9 and rings 11 are joined wherever they cross.

Each of the stems 15, except for one on the spoke 9*a* and the ring 11 a around segment 5 and ring 11*b* around segment 3, has a similar depth of 23.55 mm, approximately the same thickness as a regulation dart board, and similar width of 1.2 mm at the bottom widening out by 0.5° toward the tips 13. The tips 13 have a height of approximately 4.5 mm and a width of approximately 3.8 mm at their bottom. The tips 13 have a radius of approximately 6 mm with the point of each tip 13 rounded off at a radius of 0.25 mm.

The stem 15 of spoke 9*a* has an alignment spine 17 with an additional depth of approximately 6.5 min. The stem 15 on ring 11*a* is approximately 30.30 mm, while that on ring 11*b* is approximately *30.30* mm. The outside diameter of ring 11 a at the base of the stem is approximately 20 mm, while that of ring 11*b* is 43.46 mm. Ring 11 a does not have any connecting spokes 9 as will be discussed later. The stems 15 on rings 11*a* and 11*b* each have opposing pairs of cut-outs 18*a*, 18*b* from their bottom. The cut-outs 18*a* have a depth of approximately 7.52 mm, while the cut-outs 18*b* have a depth of approximately 11.255 mm. At a depth of approximately 3.175 mm from the bottom of each stem on rings 11*a* and 11*b* is an annular groove 18*a*, 18*b* respectively that has a height of approximately 1.17 mm.

A conductive cup 19 is fitted for each segment of the web 7 to loosely fit within the stems 15 of the appropriate spokes 9 and rings 11 fully underneath the tips 13. Each of the cups 19, except those in segments 3, 5 have sides 21 that taper towards bottoms 23. The sides 21 of cups 19*a* and 19*b* in segments 3 and 5 respectively have differing depths for reasons that will later become apparent. Each cup 19 in segments a, c and 3 have three or more spaced contacts 25 protruding from the bottom 23. Due to their smaller surface area the other cups 19 only have two contacts 25.

Although it is not strictly necessary to use three or more contacts 25 on each segment, it is recommended that at least three and even four are used due to the tendency of the cups 19 to rotate when hit by a dart at the edge of an insert 27. When four contacts 25 are placed toward the outside edges of each of the cups 19 the likelihood that contact is made at the correct time is increased. There is a possibility, although unlikely that contact could be made and released at one contact 25 of a cup 19 followed by contact on another contact 25 of the same cup due to an oscillation when a dart hits. False detection of the second contact as an independent hit can be prevented in many instances by introducing some kind of time delay mechanism into the target 1.

The cups 19 may be made from any conductive material strong enough to withstand the impact of very strongly thrown darts. Aluminum or zinc is preferred and can be hardened by anodizing or another such technique to achieve the required strength.

Alternative embodiments are also possible using conductive cups, not shown, that are conductive only in selected areas, at least one of which would maintain contact with the web 7, another would be over each pad 33 (to be discussed below), and another would connect the above selected areas. For example, a metallic strip could be glued to an otherwise plastic cup, provided the plastic cup and strip meet the other requirements of the conductive cup discussed in this description. Similarly, the web 7 could also be conductive only in parts corresponding to those of the cups 19.

A rubberized cork insert 27 fits and is glued into each cup 19, fitting flush with the lip of the cup 19. Rubberized cork is the preferred material to use as it is relatively easy to cut, durable, provides good stopping resistance for darts, and retains darts well. Other materials known to be usable for dart boards could be used as inserts 27, with consequent modification to the various dimensions, if required.

As the tips 13 overlap the cups 19 and the inserts 27, the tips 13 protect the edges of the inserts 27 from damage by the darts or other projectiles. For this reason, among others, it is important to select an appropriate material for the tips 13. For grade metal darts, anondized aluminum, zinc or another alloy is suitable, whereas plastic might be suitable for plastic darts.

Other materials could be used for the insert 27 provided they are capable of receiving and retaining the dart being used. For grade metal tipped darts, the insert 27 must also slow the dart down sufficiently so that the dart does not penetrate the cup 19, and should have a memory to fill behind the dart once it is removed. Sisal bristle is a suitable material commonly used for dart boards. Alternatively, the insert 27 could be formed for use with safety darts such as those shown in Jones et al discussed previously. In that case the insert 27 would likely be made from plastic or filled with a material that is penetrable by the safety darts.

Alternate embodiments could also be created where the functions of corresponding conductive cups 19 and the inserts 27 are integrated into a conductive block, not shown. The conductive block would take the same shape as a combined cup 19 and insert 17, but would be a single unit formed from a conductive material, such as rubberized cork or dart penetrable plastic impregnated with graphite or another conductive substance.

A circular main printed circuit board 29 rests beneath the web 7. The centre is cut away from the board 29 so that it fits around the stems of the ring 11*b* and protrudes into the cut-outs 18*b*, but not beneath the 25 point on segment 3. The top edge of the cut-outs 18*b* acts as a stop 31 for the board 29 to prevent it from travelling any further toward the front of the board 29. On the top of the board 29 beneath the contacts of each cup 19 is a discrete printed circuit board trace pad 33.

The board 29 has an alignment slot 34 that the alignment spine 27 fits to ensure that the board 29 is properly aligned. The board 29 is fastened near its outside edge to the web 7. A flange 34A projects outwardly from the bottom of the stem 15 of the outermost ring 13 for holding bolts or the like to fasten the web 7 to the board 29.

Although it is not shown in the preferred embodiment, the flange 34A could be altered to include a fixed well, not shown, to hold cork pieces, not shown, for a zero point region containing the numbers of the basic scores for each sector.

Between the board 29 and each cup 19, but not the contacts 19, is a discrete resilient foam cushion 35. The cushion is preferably glued or otherwise fastened to the cup to ensure that it does not move beneath the contacts 19. The foam used in the preferred embodiment was an elastic open cell silicon foam. The precise amount of foam required beneath each pad will depend on the type of foam used and the size of each segment. It has been found that larger segments typically require more foam per square inch. The amount of foam is selected to provide the same resilient force on each cup.

Overlapping the interior edge of the board 29 for a small distance is a concentric twenty-five and fifty point printed circuit board 37. As shown in FIG. 8, the board 37 has two opposing arced slots 39*a* and two opposing arced slots 39*b* that fit over the stems 15*a* and 15*b* respectively until the board 37 meets the board 29. At this point a first snap ring 40 is forced into the groove 8*b*. The boards 29 and 37 have an approximate thickness of 1.17 mm each and are snugly retained between the stop 31 and the snap ring 40.

The stem 15*a* of the ring 11*a*, which floats freely, is brought toward the board 37 until it meets the top edge of the cut-outs 18 that form a second stop 41. A second snap ring 43 is forced into the groove 8*a* and the board 37 is snugly trapped between the stop 41 and the ring 11*a*. This retains the ring 11*a*. The arced slots 39*a*, 39*b* should fit over the stems 15 fairly snugly as well to limit rotational movement of the board 37.

Other fastening means could be used in place of the snap rings 40, 43, such as threading annular locking rings, not shown, onto the stems 15*a* and 15*b*, preferably they would provide a quick release of the respective boards 29, 37 in the sense that they would not require tools or any special skill to remove.

Some form of hook or other fastening means, not shown, is used to hold the target against a wall or other substantially vertical surface.

In order to disassemble the target, it is taken down from the wall. If the 50 point needs replacement (it has heavy use), the second snap ring 43 is simply removed and the ring 11*a* slips out the front of the target. The cup 19*a*, including its insert 27 is replaced and the ring is reinserted into the target 1 with the ring 43 snapped into placed.

If the ring 11*b* needs replacement then ring 11*a* is removed as discussed above. The target 1 is placed face down and ring 40 is then removed, This allows the board 37 to be removed for access to the cup 19*b*. That cup 19*b* can be removed and replaced. The target 1 is re-assembled in reverse order.

For access to the other cups 19, when the board 37 is removed, the board 29 is also removed by loosening the fastening devices at its outer edge. The remaining cups 19 are now accessible and can be replaced, or even interchanged if that is desired, and the target re-assembled in reverse order.

To increase the length of time that a given cup may be used before replacement is required, the target may be rotated so that high use sectors, the 20, 18 and 1 basic score sectors typically have the highest use, are moved to lower use sectors. It is then necessary to make the target 1 aware of the change so that automated scoring is unaffected. This will be discussed further below.

Of course, the segments in the sectors will eventually wear out and the ability to easily replace the segments using a means such as that set out above is highly advantageous.

Rotation of the segments 3, 5 does not affect the length of time they may be used, so it is also advantageous that they can be easily changed by using a means such that described previously.

The target 1 is set within a casing, not shown, for protection. The casing could have the hook mentioned earlier to attach the target 1 to a wall. The casing could also have on its face the value of the basic score of each sector.

RING COUNTER AND LATCH CIRCUIT

Referring generally to FIGS. 6*a*–6*g*, a circuit 45 connects each of the 62 different segments from the pads 33 to respective inputs of multiplexers U1 through U8. This leaves 2 remaining inputs—one of which is unused, the other is connected to a no score segment as will be discussed further below.

The circuit 45 is on the printed circuit boards 29, 37. The circuit interfaces to another board, referred to as the processor board, not shown. The processor board is set behind the target 1 within the casing and is connected to the circuit 45 via a 26 conductor ribbon cable, not shown. The processor board contains a processor and a programmable read-only-memory PROM, not shown. The PROM contains computer programs for use by the processor, a 8051 was used, to control the operation of the target 1, as described below, and also display, audio communication, coin collection and user interface functions. The display, not shown, provides a visual indication of the players scores. Audio communication, not shown, plays back suitable noises for game situations, such as a cheer when a bullseye, segment 5, is struck. The processor communicates with a coin collection device, not shown, for receiving and calculating the amount of money put into the device by the players. The user interface, not shown, might include switches, such as On-Off, number of players or game selections. The number of players is needed for control of the target during play: it is also needed to determine how much money is needed to play. Game selections might be well known dart games, such as 301, 501, 701 or Cricket. A change in the game selection would typically require the processor to use a new scoring algorithm. Examples of these aspects of automated dart boards is well known in the art and will not be further set out herein.

Integrated circuits U9, U10 and U12 implement a ring counter 47 that indicates the status of the current segment being sensed as well as physically sensing the state of the segment.

U9 contains two four bit, binary counters. The upper two bits of the first and all four bits of the second make a six bit counter with a capability to count to 64. Because the first two bits of the counter are not used, four pulses at a clock input of U9 are needed to move the counter by one. An address latch enable line (ALE) of the 8051 processor on the processor board serves as a counter clock.

Of the six counter lines, the least significant three control the one-of-eight multiplexers U1 through U8. The three control lines go to the control inputs of each of the eight multiplexers U1 through U8. Each multiplexer U1 through U9 enables one of eight segments to which it is connected to be sensed by another one-of-eight multiplexer U10. The most significant three output lines from the counter 47 control multiplexer U10 which in turn allows one of the eight lines connected to its inputs to be sensed by latch U12. This brings the state of the circuit 45 under the control of the processor board to the "Initialize . . ." box of FIG. 7. When the target is started, the ring counter 47 is set to zero.

The circuit then moves to the "Start ring counter . . ." box of FIG. 7. The counter 47 is then started and the net effect is to connect in turn each of the 63 segments to be sensed to the latch U12 allowing polling of each segment and sensing of its status.

The six counter lines are also connected through a 26 pin connector, not shown, to a processor board, not shown.

These lines are shown as KDTA through KDTF on FIG. 6. The lines provide a processor board, not shown, with the identity of the segment currently being sensed by the circuit 45.

Although it is not shown in the Figures, the web 7 is held at a logic low, in this case ground. Through contact with the web 7, the cups 19 are also at a logic low. When a segment is hit by a dart, its cup 19 is pushed toward the back of the target 1 and it contacts 25 contact the pad 33 beneath it.

The inputs to the multiplexers U1 through U8 are normally held in a high state by resistors R1 tied to the supply voltage Vcc. In the event an active segment state, i.e. a segment that has been hit by a dart, causes a normally high state to go low, the low state is latched into latch U12 and the processor board is notified through line KDTIN. This way the processor board knows that a segment has been hit by a dart and exactly which segment has been hit.

The circuit 45 is in the "Hit has occurred?" and "Is count less than or equal to 61?" diamonds of FIG. 7. For the purpose of this part of the discussion, it is assumed that a hit has occurred and that the count is less than 61. If so the state flow of the circuit 45 continues to the "assign dart hit . . ." box. If there is no hit then the target simply keeps counting until a hit is sensed. To determine if the count is less than 61 a subcircuit shown in FIGS. 6*f–g* detects a dart hit and if no segment is active low, it assumes that the dart missed the target and outputs a count of 62. This is described more fully under the heading NO SCORE DETECTION below.

The circuit 45 is now in the "Is count less than or equal to 61?" diamond of FIG. 7. Upon receiving the count information, the processor updates a scoring display and sounds an appropriate sound from memory on the processor board. The processor also sends a reset pulse to the circuit via a KRST line that causes the latch U12 to reset to a high state, i.e. an inactive state.

The circuit 45 is now in the "Start Ring counter . . ." box of FIG. 7. At the same time, the KRST line resets the ring counter 47 to zero, from which point it again starts to count upwards. The polling of each segment of the target happens at least once every millisecond and the contact time of the cups 19 and contacts 23 in the preferred embodiment is approximately 5–10 milliseconds, thereby making it highly unlikely that a dart will hit a segment without being sensed. The polling rate may have to be increased with changes in the rebound time of the cushions 35, which will be a function of the typical dart impact weight, the resiliency of the cushion 35 and the friction between the cups 19 and web 7.

HIT AND NO SCORE DETECTION

In the circuit 45 is a subcircuit that first detects a hit and then detects a failure to hit any of the 82 scoring segments, a dart has landed either in the no scoring segment or has hit the web 7 and bounced off.

This returns the circuit 45 to the "Hit has occurred?" diamond of FIG. 7. The motion of the target 1 caused by a dart hit is detected by one or more piezoelectric sensors mounted on the target 1. In the preferred embodiment 4 sensors are used, 49*a–d*. Although it is not shown on the Figures, the sensors 49*a–d* are mounted against the back of the target 1 casing equally spaced about the perimeter so as to contact the wail. Every dart hit is detected by the sensors 49*a–d* and is converted into a low TTL pulse by comparator U100. The output of the sensors 49*a–d* is clipped by a 4.8 V zener diode before being introduced into the comparator U100. The comparator U100 also contains a small amount of hysteresis in order to prevent ringing at the points of transition of the pulse. This is done by resistor R100 that connects the output of the comparator U100 to the positive input of the comparator U100.

The output of the comparator U100 is connected to two monostables U101. The first monostable U101 a generates a 800 millisecond high pulse, the falling edge of which triggers the second monostable U101*b* to generate an 8 microsecond high pulse. The rising edge of this pulse, in turn, triggers another monostable U102 to produce an 800 microsecond low pulse that is connected to the no scoring segment in the target circuit 47.

The circuit 45 is then leaving the "Hit has occurred?" box of FIG. 7 with a YES and a count of 63 to return to the "is count less than 61?" diamond described above. If within the 800 milliseconds of a first monostable U100*a* pulse, no scoring dart is sensed, the subcircuit outputs a pulse on the 63rd segment which is decoded by the processor as a dart that created zero score.

The circuit 45 is then leaving the "Hit has occurred?" diamond of FIG. 7 on the YES line and returning to the "Is count less than or equal to 61" diamond with the count as sensed above undisturbed. On the other hand, if the dart actually hit a segment which resulted in latch U13 to go low (KDTIN), another chain of events ensues. The low KDTIN triggers one of two monostabies 103*a*, 103*b* to generate a 0.5 second high pulse. The falling edge of this pulse creates another low pulse in monostable U103*b*. This low pulse in turn causes U101 and U102 to be reset, thereby cancelling the no score pulse that was in the process of being created and that would have resulted in a zero score at segment 63.

The use of sensors 49 to detect each hit on or near the target 1 and the circuitry 45 checking to see if a dart has hit a segment can result in a lower component implementation of the no hit function than using sensors, not shown, on and off the target 1 and comparing the difference in the signals.

UPPER VERTICAL SECTOR SENSING CIRCUIT

As discussed previously, when sectors having a high basic score get worn out earlier than sectors with low basic scores, the target 1 may simply be rotated (the preferred embodiment does this in steps of two sectors when the target 1 is powered down) in order to reassign sector basic scores. As will be described further below, the processor is notified of the specific sector that is currently in the upper vertical position by means of a bank of 10 switches, one of which is toggled ON. The switch that is toggled ON corresponds to the sector that is currently in the upper vertical position. This reduces maintenance intervals.

While the target 1 is powered, the processor board polls the target every 12 milliseconds to ascertain which sector is currently the upper vertical sector. This is done through two control lines P7, P9 that originate from the processor. It is really only necessary to poll the target 1 once when the target is powered up, however continuous polling builds some redundancy into the target 1.

Normally P9 and P7 are high and low respectively. When this state is inverted, the inverted or gate output U13 pin 6 goes low, thereby pulling one pair of basic score segments in a sector low. The pair of segments that are pulled low is determined by a bank of ten switches in which one switch is closed. With U13 pin 6 being low, the processor is informed of which sector is low by the current state of the ring counter 47. This information is stored in memory of the processor board to properly evaluate the segment that has been hit by a dart and what score to attribute to that hit.

Once the identity of the upper vertical sector is established, P9 and P7 lines revert to the high and low state respectively.

It will be understood by those skilled in the art that this description is made with reference to the preferred embodiments and that it is possible to make other embodiments employing the principles of the invention which fall within its spirit and scope as defined by the following claims.

I claim:

1. A target for use with a projectile, the target comprising:

a. a web made from conductive material, the web defining a target face, the web having a depth and the web defining one or more segments within the web that open toward the target face;

b. one or more conductive blocks slidably mounted and substantially filling the target face of one or more respective segments of the web, each block contacting the web;

c. a back board mounted to and behind the web, the back board having at least one conductive pad for each of the blocks;

d. a resilient cushion for each of the conductive blocks, between each block and the back board;

wherein the projectile impacting a block at the target face with sufficient force causes the block for that insert to slide within the web and contact a pad beneath that block, and wherein the cushion beneath that block resiliently returns the block substantially to its original position.

2. A target for use with a projectile, the target comprising:

e. a substantially rigid web made from conductive material, the web defining a target face, the web having a depth and the web defining one or more segments within the web that open toward the target face;

f. one or more conductive cups slidably mounted and substantially filling the target face of one or more respective segments of the web, each cup contacting the web and having a mouth that opens toward the target face;

g. an insert mounted within and substantially filling each cup to the target face;

h. a back board mounted to and behind the web, the back board having at least one conductive pad for each of the cups;

i. a resilient cushion for each of the conductive cups, between each cup and the back board;

wherein the projectile impacting an insert at the target face with sufficient force causes the conductive cup for that insert to slide within the web and contact a pad beneath that cup, and wherein the cushion beneath that cup resiliently returns the cup substantially to its original position.

3. A target according to claim 2 for use with projectiles that are darts, wherein the insert is formed from a material for generally receiving and retaining the darts.

4. A target according to claim 3, wherein the insert is formed from a material for substantially filling in behind the darts when they are removed.

5. A target according to claim 4, wherein the web further comprises, a plurality of substantially concentric spaced apart rings and a plurality of equally spaced spokes emanating from the second to the innermost ring, the spokes defining circular sectors, the two innermost rings defining two segments, and intersecting spokes and rings defining the remainder of the segments.

6. The target of claim 5, wherein the innermost ring is connected by a quick release mechanism to the back board for quick removal of the innermost ring and easy access to the conductive cup in the innermost ring for removal of that cup from the target.

7. The target of claim 6, wherein the quick release mechanism comprises at least one first extension of the innermost ring through the back board, the at least one first extension having a first groove substantially parallel to the back board for receiving a first snap ring that maintains the back board snugly against the unextended portion of the innermost ring.

8. The target of claim 7, wherein the back board comprises a main board and a centre board, wherein the main board has an area beneath substantially the entire inside diameter of the second to the innermost ring removed, and the centre board extends beneath that area and overlaps the main board, wherein the at least one first extension extends through the centre board and the second to the innermost ring has at least one second extensions of the second to the innermost ring through the centre board, the main board having projections beneath the unextended portion of the second to the innermost ring, the at least one second extension having a second groove substantially parallel to the centre board for receiving a second snap ring that maintains the centre board and main board snugly against the unextended portion of the second to the innermost ring.

9. A target according to claim 5, wherein the web has a tip on each of the rings and spokes that extends into the segments and retains each of the conductive cups.

10. A target according to claim 9, wherein the tip substantially covers the entire face of the web and substantially covers the entire rim of each conductive cup.

11. A target according to claim 10, wherein the tip is made from a material that can withstand the impact of the darts over a long period of use.

12. A target according to claim 5, wherein the insert comprises rubberized cork.

13. A target according to claim 12, wherein each insert is glued to its respective cup.

14. A target according to claim 5, wherein each of the cushions is formed from foam rubber.

15. A target according to claim 14, wherein the foam rubber is open celled silicon foam.

16. A target according to claim 5, wherein the back board is a printed circuit board and the pads are traces on the back board.

17. A target according to claim 5, wherein the web and the cups are formed from aluminum.

18. A target according to claim 5, wherein the web and the cups are formed from zinc or another alloy.

19. A target according to claim 16, the web has 6 rings, and the back board conductively connects the pads beneath segments in the same sector between the second and third to the innermost rings and the fourth to the fifth innermost rings.

20. A target according to claim 19, wherein the target has circuitry to poll each of the pads at least once during the time that contact would likely be occurring between a cup and a pad as the result of an impact from a projectile.

21. A target according to claim 20, wherein the web is normally held at a first potential, the pads are normally held at second potential, the cups through contact with the web are at the first potential and contact between a cup and pad results in a momentary change in status of the pad substantially to the first potential, and polling by the circuitry senses the change in status.

22. A target according to claim 21, further comprising a vertical sector sensing means for determining the sector that is in the vertical position.

23. A target according to claim 22, further comprising switches for selecting the sector that is to be in the vertical position.

24. A target according to claim 20, further comprising no hit detection means for vibrationally sensing a dart hitting on or near the target and determining if contact has been made between a cup and a pad approximately when the dart impacted on or near the target, and if no such contact was made, providing a no hit indication.

25. A target according to claim 5, the target further comprising means for detecting the rotational position of the target.

26. A target according to claim 25, further comprising a vertical sector sensing means for determining the sector that is in the vertical position.

27. A target according to claim 26, further comprising; switches for selecting the sector that is to be in the vertical position.

28. A target according to 5, further comprising; no hit detection means for vibrationally sensing a dart hitting on or near the target and determining; if contact has been made between a cup and a pad approximately when the dart impacted on or near the target, and if no such contact was made, providing a no hit indication.

29. A target according; to claim 5, further comprising; circuitry for normally holding the web at a first potential and the pads at a second potential, and sensing when a dart has impacted a given segment by determining when a pad has momentarily taken substantially the potential of the web through contact with the conductive cup corresponding with that pad.

30. A target according to claim 29, wherein the circuitry determines when a pad has momentarily taken substantially the potential of the web by polling the pads at a rate greater than the time the conductive cups are likely to remain in contact with the pads.

* * * * *